US005385073A

United States Patent [19]

Truemner et al.

[11] Patent Number: 5,385,073

[45] Date of Patent: Jan. 31, 1995

[54] APPARATUS FOR PERFORATING CORRUGATED TUBING AT HIGH SPEEDS

[76] Inventors: Dale Truemner, Pigeon; Richard Booms, Bad Axe, both of Mich.

[21] Appl. No.: 19,026

[22] Filed: Feb. 18, 1993

Related U.S. Application Data

[63] Continuation-in-part of Ser. No. 831,690, Feb. 5, 1992.

[51] Int. Cl.[6] ..... B26D 1/28

[52] U.S. Cl. ..... 83/322; 83/54; 83/340; 83/591; 83/672

[58] Field of Search ..... 83/54, 340, 672, 592, 83/591, 322

[56] References Cited

U.S. PATENT DOCUMENTS

| | | | |
|---|---|---|---|
| 627,462 | 6/1899 | Legg | 83/340 |
| 1,510,729 | 10/1924 | Weisner | 83/340 X |
| 2,540,058 | 7/1948 | Stern | 83/340 X |
| 3,370,491 | 3/1966 | Cross | 83/54 X |
| 3,824,886 | 7/1974 | Hegler | 83/329 |
| 3,957,386 | 5/1976 | Lupke | 408/50 |
| 4,158,534 | 6/1979 | Hegler et al. | 83/54 X |
| 4,180,357 | 12/1979 | Lupke et al. | 409/131 |
| 4,218,164 | 8/1980 | Lupke et al. | 409/131 |
| 4,270,878 | 6/1981 | Fales | 409/143 |
| 4,488,467 | 12/1984 | Hegler et al. | 83/303 |
| 4,587,874 | 5/1986 | Lupke et al. | 83/340 |

FOREIGN PATENT DOCUMENTS 2230767 1/1974 Germany .

*Primary Examiner*—Eugenia Jones
*Assistant Examiner*—Kenneth E. Peterson
*Attorney, Agent, or Firm*—Weintraub, DuRoss and Brady

[57] ABSTRACT

Apparatus for perforating corrugated tubing of large diameter is achieved by use of multiple cutters disposed within the threading on the feeder-cutter wheels. The apparatus receives tubing to be perforated along an axial path coincident with the axis of the tubing. A plurality of feeder-cutter wheels drive the tubing through the apparatus and concurrently perforate the tubing in the valley of its corrugations by virtue of a plurality of cutters disposed within the threading. These multiple cutters allow perforation of larger diameter tubing in the range of nine to twelve inches. Each feeder-cutter wheel, and the drive shaft each wheel is mounted upon, is offset at an angle relative to the axial path, this angulation facilitating uniform perforations at higher speeds. This design permits the wheels to be interchangeable with different wheels, allowing the apparatus to perforate tubing of different diameters.

5 Claims, 5 Drawing Sheets

APPARATUS FOR PERFORATING CORRUGATED TUBING AT HIGH SPEEDS

BACKGROUND OF THE INVENTION

This application is a continuation-in-part of copending U.S. patent application Ser. No. 07/831,690, filed Feb. 5, 1992, the disclosure of which is incorporated herein by reference.

1. Field Of the Invention

The present invention concerns an apparatus for perforating corrugated tubing. More particularly, the present invention concerns an apparatus for perforating corrugated tubing at a high rate of speed. Also, the present invention concerns a method for achieving the same.

2. Prior Art

Machines for perforating tubing are known. U.S. Pat. No. 3,824,886 issued Jul. 23, 1974 to Hegler, teaches an apparatus for cutting apertures in corrugated tubing by rotating the cutter circumferentially around the tubing. The cutter is disposed within a ridge on a wheel, which is driven by a transmission. The wheel and cutter cooperate with a roller to rotate about the tubing. The cutter travels in an epitrochoidal path around the outer surface of the tubing, causing a perforation where the cutter strikes the tubing. Hegler achieves perforations perpendicular to the axis of the tubing by this method.

While offering a relatively simple design to achieve its ends, Hegler is necessarily limited to perforating corrugated tubing at relatively low speeds due to the necessity of the wheel and cutter traveling the entire length of the corrugation. Increasing the traveling speed of the wheel beyond modest levels would result in miscuts in the tubing, such as cuts in the side walls of the corrugation instead of the valley thereof. Further, excessive wheel speed would cause the wheel to jump past corrugations, thus missing areas of the tubing and leaving these areas unperforated.

U.S. Pat. No. 4,180,357 issued Dec. 25, 1979 to Lupke et alia teaches an apparatus for perforating tubing. Lupke et alia teaches a machine having a plurality of lead screws for driving the tubing along an axial path, the lead screws meshingly engaging with the corrugations of the tubing. Each lead screw is mounted on an axis of rotation parallel to the axial path of the tubing. Mounted upon each lead screw is a cutter, flanked on each side by a raised rib. The cutter is in a plane substantially at a right angle to the axial path and the cutter intermittently intersects the tubing. Lupke achieves rotation of the lead screws by a system of gear wheels coordinated such that pairs of lead screws cut the tubing simultaneously. Lupke can achieve a maximum horizontal tubing speed of 20 feet per minute while cutting. At speeds greater than 20 feet per minute, the apparatus of Lupke experiences difficulty in realigning the cutter and properly perforating the tubing.

U.S. Pat. No. 4,218,164 issued Aug. 19, 1980 to Lupke et alia teaches an improvement upon the previous Lupke apparatus of the '357 patent. The plurality of lead screw members have a helically raised rib member mounted centrally thereon, the helical rib replacing the raised straight ribs of the previous apparatus. The cutter is disposed at the end of the helical rib. The helical rib tends to facilitate entry of the cutter into the valley of the corrugation. The rib extends around only a portion of the circumference of the shaft, thus continuing the teaching of intermittent intersection by the cutter as taught in the previous Lupke patent. This apparatus achieves a horizontal tubing speed of approximately 40 to 50 feet per minute. At speeds in excess of 50 feet per minute, the apparatus tends to climb the side walls of the corrugation and perforate either those walls or the crown of the corrugation.

The devices of the Lupke et alia patents overcome the limitation of rotating the entire cutter wheel around the tubing as taught by Hegler. In the first Lupke patent, the plurality of raised ribs essentially slowed the horizontal movement of the tubing long enough to effect the perforation. The apparatus of the second Lupke patent substituted the helical rib for the plurality of straight ribs. This alleviated the need to slow or stop the horizontal travel of the tubing along the axial path to effect the perforation, and works relatively well at lower speeds, i.e. speeds less than 50 feet per minute.

However, both Lupke apparatuses encounter serious problems when greater speeds are attempted. When operated at speeds in excess of 50 feet per minute, the cutter of the first Lupke apparatus is not able to spring back to its original start position for the next intermittent engagement of the tubing. Thus, the cutter is not able to perforate the valley of the corrugation, but rather cuts into the side wall, miscutting the tubing. Similar problems occur with the second Lupke apparatus.

Additionally, problems are encountered with the feed worms of Lupke. At high speeds, the vertical sides of the feed worms are unable to maintain their helical course in the corrugation. Thus, the worms tend to climb the side walls of the corrugations, crushing the crown of the tubing and skipping parts of the corrugation.

It is therefore the goal of the present invention to overcome the problems heretofore encountered in the prior art. It is a purpose of the present invention to provide an apparatus capable of perforating corrugated tubing at axial speeds in excess of 50 feet per minute, and further to perforate tubing at speeds of 150–200 feet per minute.

It is a further purpose of the present invention to achieve higher axial speeds while providing a simpler design by eliminating the necessity of complicated gear networks to achieve timing relationships.

It is a still further purpose of the present invention to provide an apparatus for perforating tubing of various diameters without the necessity of recalibrating timing relationships or the need for a completely new drive shaft arrangement.

It is to these ends that the present invention is directed.

SUMMARY OF THE INVENTION

The present invention defines an apparatus for cutting perforations in corrugated tubing of a large diameter as the tubing is passed along an axial path thereof, the apparatus comprising:

(a) at least one pair of feeder-cutter wheels, each wheel comprising a worm, a threading provided on the worm, and a plurality of cutters disposed within the threading, each wheel being adapted to continuously intersect the corrugation of the tubing;

(b) at least one pair of drive shafts, each drive shaft having one wheel axially mounted thereon, the drive shafts being deployed at an angle relative to the axial path of the tubing to apply pressure to the tubing as it is moved past the wheels;

(c) means for rotating the drive shafts; and wherein the feeder-cutter wheels are operable to drive the tubing along the axial path through the apparatus and to cut perforations in the corrugation of the tubing.

The drive shafts of the present invention each comprise a forward portion, a rearward portion and a plurality of U-joints interconnecting the forward portion and the rearward portion and permitting the angling of the feeder-cutter wheel.

Optimally, the feeder-cutter wheel and the drive shaft upon which the wheel is mounted are deployed at an angle approximately the average of the helical angle of each wheel of the set of feeder-cutter wheels to be disposed on the drive shafts. The set of feeder-cutter wheels is defined as comprising the feeder-cutter wheels which may operatively be mounted upon the drive shafts of a given apparatus for cutting perforations of the present invention, each set of wheels directed to perforating tubing of a different diameter.

The present invention further defines a method for perforating tubing, the method comprising the steps of:

(a) feeding the tubing along an axial path of an apparatus for perforating corrugated tubing, the axial path of the apparatus being coaxial with the axis of the tubing;

(b) intersecting the tubing with a plurality of feeder-cutter wheels, each of the wheels comprising a worm, a spiral threading disposed upon the worm and a plurality of cutters disposed within the threading, the wheel mounted upon a drive shaft, the wheel and the drive shaft being disposed at an angle equal to the helical angle of the threading, the angle being relative to the axial path;

(c) driving the tubing along the axial path by rotating the wheels, the tubing being in continuous intersection with the wheels; and (d) perforating the tubing at desired intervals while driving the tubing.

Steps (c) and (d) of the preceding method may be repeated as the length of the tubing is driven through the apparatus.

The present invention may also comprise a tubing perforation set capable of perforating tubings of different diameters without realignment, the set comprising:

(a) at least two groups of feeder-cutter wheels, each wheel of a group having the same diameter, each group having a diameter different from other groups, each group comprising at least one pair of feeder-cutter wheels, each wheel comprising a worm, a threading disposed upon the worm, and a plurality of cutters disposed within the threading, each wheel being adapted to continuously intersect the corrugation of the tubing;

(b) an apparatus for cutting perforations in corrugated tubing of a large diameter as the tubing is passed along an axial path thereof, the apparatus comprising:

(1) at least one pair of drive shafts, each drive shaft having one wheel of a group of wheels axially mounted thereon, the drive shafts being deployed at an angle relative to the axial path of the tubing to apply pressure to the tubing as it is moved past the wheels;

(2) means for rotating the drive shafts; and wherein the feeder-cutter wheels are operable to drive the tubing along the axial path through the apparatus and to cut perforations in the corrugation of the tubing, and wherein the groups of wheels may be interchangeable upon the drive shafts without requiting realignment of the drive shafts.

The present invention will be more clearly understood with reference to the accompanying drawings, in which like reference numerals refer to like parts, in which:

DETAILED DESCRIPTION OF THE PREFERRED EMBODIMENT

Figure 1:
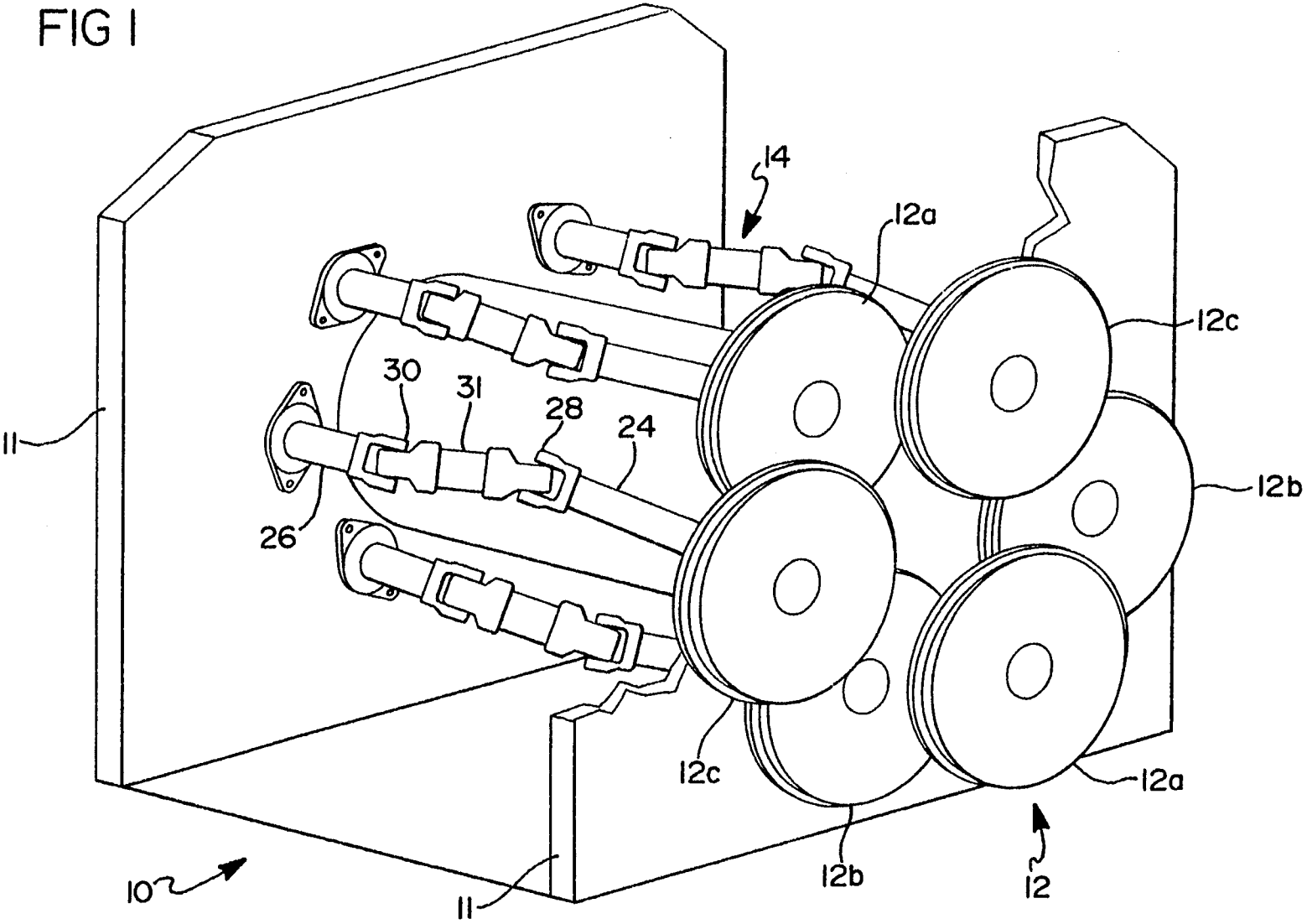
FIG. 1 is a perspective view of a first embodiment of the apparatus for perforating corrugated tubing of the present invention, with a part of the housing cut away.

With reference now to FIGS. 1–4, there is shown therein an apparatus 10 for perforating corrugated tubing in accordance with the present invention. The apparatus 10 comprises a plurality of feeder-cutter wheels 12, a plurality of drive shafts 14, and means 16 for rotating the drive shafts 14. The apparatus 10 further has a housing 11 for support of items mounted thereon.

The feeder-cutter wheels 12 comprise a worm 18, a rotatable shaft 19, a threading 20 and a plurality of cutters 22, 22' and 22''. The worm 18 comprises a solid cylindrical body, the diameter of which is determined by the size of the tubing T to be perforated. The worm 18 is forwardly joined on the rotatable shaft 19. The threading 20 is disposed helically upon the outer surface of the worm 18. The threading 20 facilitates the intersection and intermeshing of the wheel 12 with the corrugated tubing, indicated at T. The cutters 22, 22', 22'' are disposed within the helical threading 20 on the outer surface of the worm 18. The cutters 22, 22', 22'' are hardened and sharpened bits mounted into the worm 18, the cutters 22, 22', 22'' having a hook extending slightly above the threading 20. As will be described further herein below, the threading 20 and the cutters 22, 22', 22'' of the wheel 12 cooperate so as to concurrently drive the tubing T through the apparatus 10 and perforate the tubing T.

The feeder-cutter wheels 12 are larger in size than the cutter wheels previously known in the art. Prior apparatuses, particularly the Lupke machines, utilized relatively small cutters, about 1 to 1.5 inches in diameter. Such prior apparatuses did not teach wheels of varying sizes. The present invention as embodied in the apparatus 10 utilizes wheels larger by a factor ranging from 3 to 6. When it is desired to perforate a tubing T of a larger diameter, a feeder-cutter wheel 12 of a smaller raised diameter is used. It is by these smaller wheels 12 and the use of multiple cutters 22, 22', 22'' that tubing T of a larger diameter can be cut at speeds not heretofore possible.

To achieve utilization of larger wheels 12 than previously known in the art, and to utilize the plurality of pairs of wheels as intended, the wheels 12 are set in different operating planes. The wheels 12 are normally deployed in pairs. Each wheel 12 of the first pair is deployed in a different plane of rotation, denoted here as 12*a*. Each succeeding pair of wheels is then deployed in a different and distinct plane of rotation from the wheels 12*a* of the first pair. Here the second pair are denoted as 12*b* and the third pair as 12*c*. It is to be noted that each wheel 12 of deployed succeeding pair of wheels rotates in the same plane of rotation. Not only does this deployment of the wheels 12 in different planes achieve the usage of larger wheels 12 and the benefits therein, but also the deployment of wheels in different planes achieves interchangeability of feeder-cutter wheels 12 of different diameters without necessity of changing drive shafts 14 or the calibrations thereof, as will be discussed herein further below.

Figure 3:
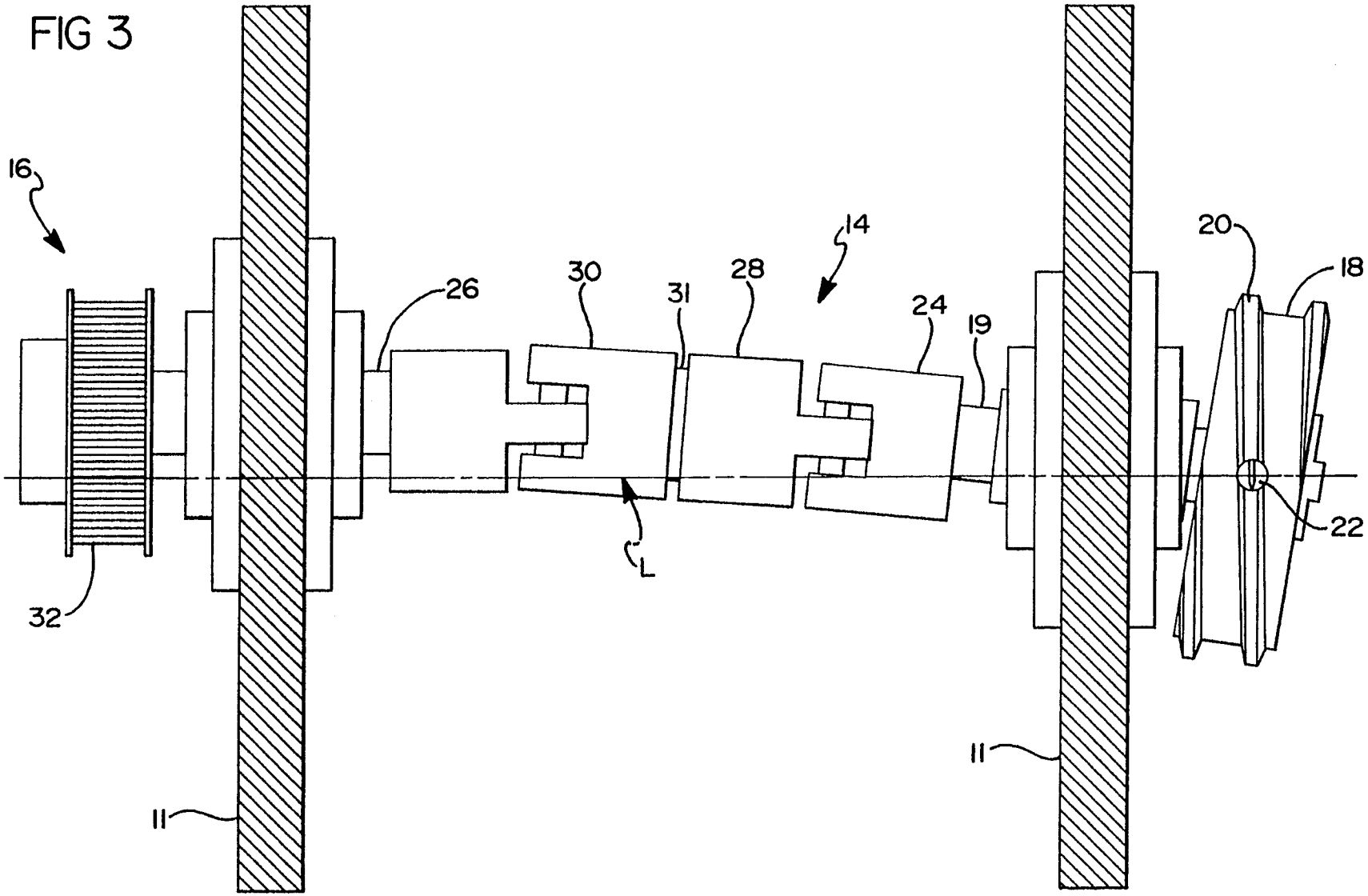
FIG. 3 is a top view of the feeder-cutter wheel and drive shaft of the first embodiment, the drive shaft having U-joints for angling the wheel and shaft.
Figure 4:
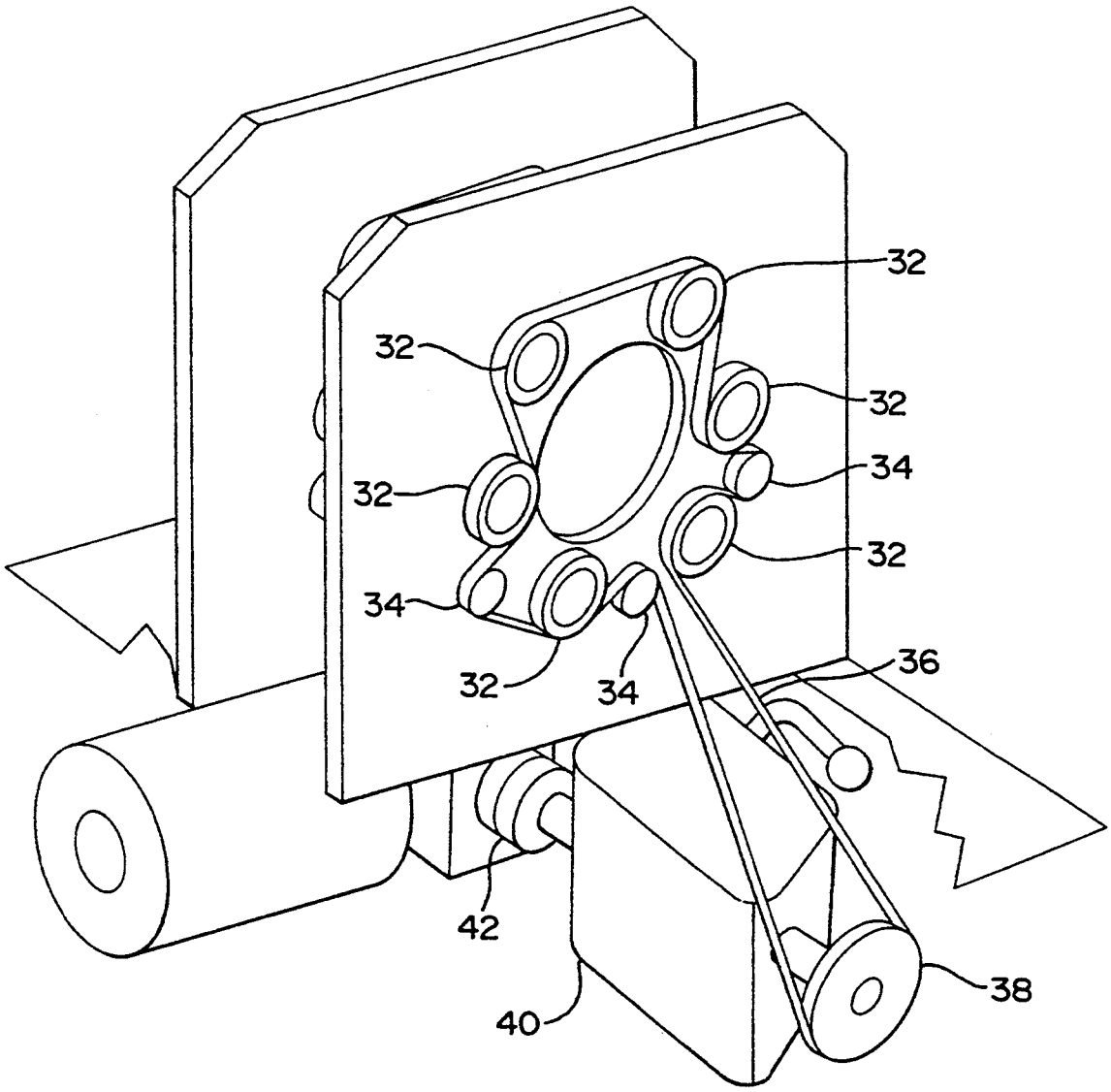
FIG. 4 is rear view of the apparatus of the present invention, showing three pairs of drive wheels having a belt disposed therearound, the belt connected to means to driving.
Figure 5:
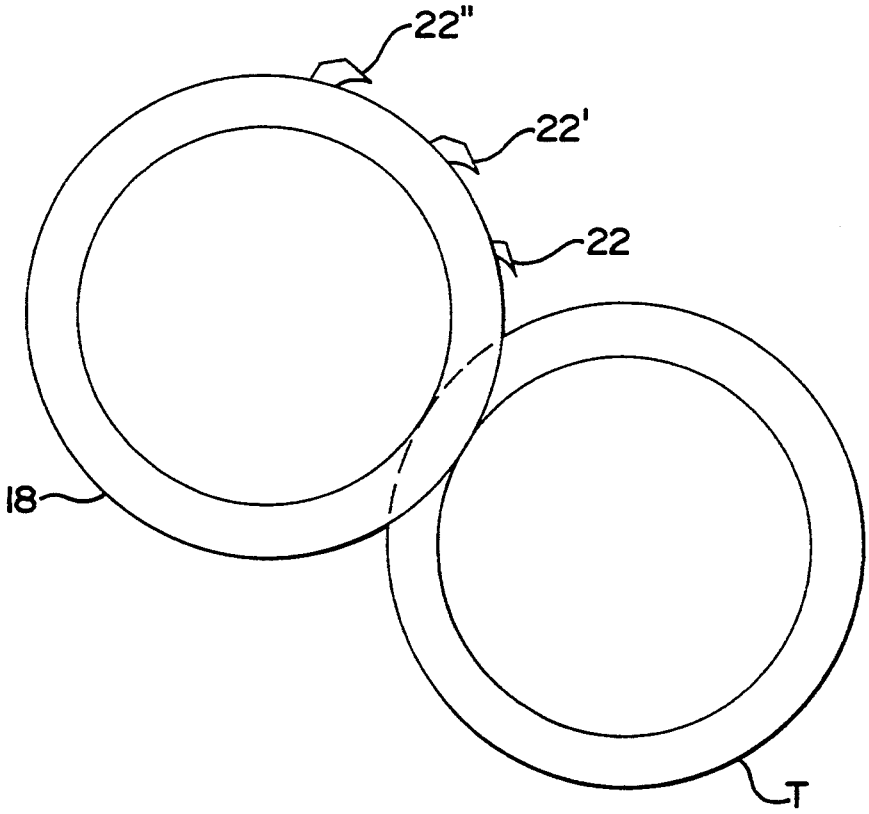
FIG. 5 is a cross-sectional view of a single wheel interconnecting with and preparing to perforate a tube.

Each wheel 12 is mounted upon a corresponding drive shaft 14. The drive shaft 14, in the preferred mode, comprises a forward portion 24, a rearward portion 26 and at least one U-joint 28 interconnecting the forward portion 24 and the rearward portion 26. As shown in FIG. 3, the forward portion 24 receives therein the rearward portion of the rotatable shaft 19, thereby connecting the wheel 12 to the drive shaft 14. The forward portion 24 is then joined to a first U-joint 28. As shown in FIG. 3, the drive shaft 14 has two U-joints 28, 30. The first U-joint 28 is connected to a second U-joint 30 by an intermediate piece 31. The second U-joint 30 is connected to the rearward portion 26 of the drive shaft 14. The rearward portion 26 is connected to means for driving 18, as described herein further below.

Figure 2:
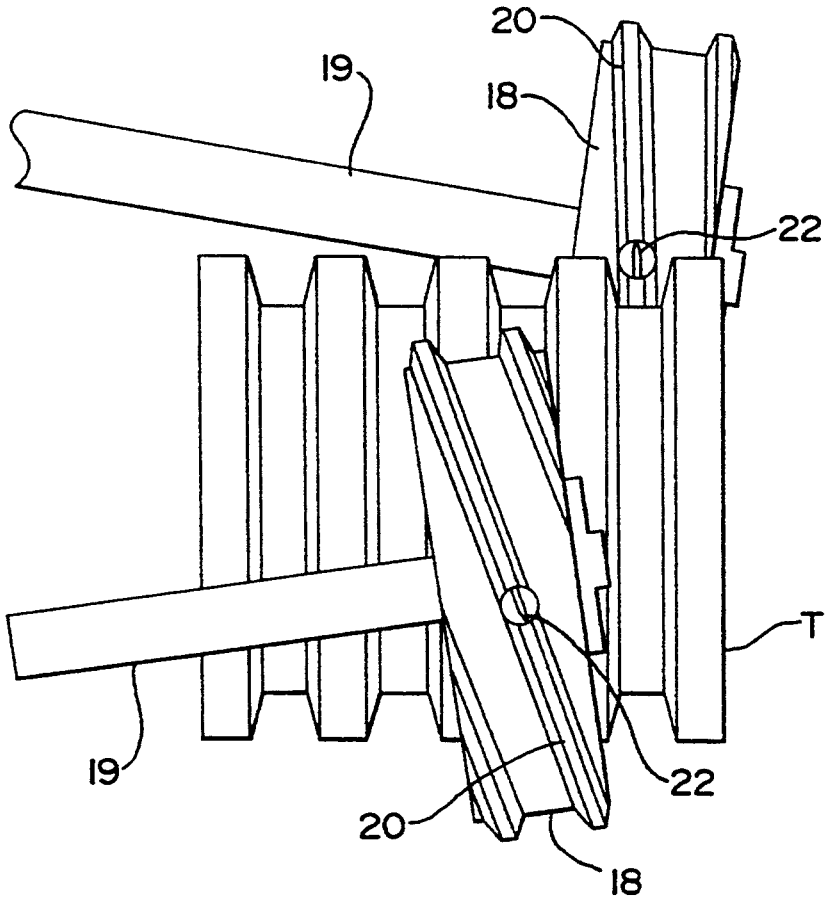
FIG. 2 is a side view of a pair of feeder-cutter wheels and drive shafts of the first embodiment, deployed on a section of corrugated tubing, the wheels having a plurality of cutters deployed thereon.

The drive shaft 14 and the mounted feeder-cutter wheels 12 are offset at an angle relative to the axial path of the tubing T and the apparatus 10, the axis of the tubing T and the axis of the apparatus 10 being identical or coaxial and shown as L in FIG. 2. To achieve maximum speed in perforating the tubing T, the drive shaft 14 and corresponding wheel 12 are set at an angle substantially equal to the average of the helical angles of the threadings upon all of the feeder-wheels 12 to be deployed on the drive shafts 14 of the apparatus 10. In the typical apparatus 10, it has been found that such an angle supplies sufficient and necessary pressure upon the wheel 12 to keep the threading 20 rotating through the corrugation of the tubing T. This then facilitates the perforation of the tubing T by the cutter 22 in the valley of the corrugation, and not in the side wall or crown of the tubing T.

Plastic corrugated tubing, as it is commonly and uniformly manufactured today, has the characteristic of being thickest at the valley of the corrugation and on the crowns of the corrugation. Thus, the side walls of the tubing are comparatively weak due to the manufacturing techniques utilized. This is particularly true of thicker tubing, which has a substantially increased thickness at the valley of the corrugation. Following the principle of seeking the path of least resistance, the known apparatuses for perforating tubing will often, and especially at speeds exceeding 50 feet per minute, miscut the tubing because the cutter cannot slit the thick plastic at the bottom of the corrugation. Thus, the tubing is cut on the side walls, or less commonly, on the crown.

This problem is accentuated in tubing of larger diameters. In such tubing, the pitch of the corrugations reach 2 inches and achieve valley thicknesses of 150/1000 inch. To perforate such tubing, known machines stick within a corrugation and then are thrown by the excessive torque over the crown and into forward corrugations. This can damage the tubing, but also the torque can damage the gear train and cutters of the perforating machines.

Additionally, it must be noted that the plastic corrugated tubing currently available on the market does not have any helical angle to its corrugations. Tubing with a helical angle was previously known, but none is known to be currently available or in use. The importance of the lack of a helical angle in the tubing relates to the cutting ability of previously known machines and the present invention.

The previous apparatuses known for perforating corrugated tubing, particularly the Hegler machine and the second Lupke apparatus, teach the use of a cutter wheel having a helical rib thereon. But the helical rib, naturally having an angle therein, is incapable of effectively interfacing with corrugated tubing which does not have a corresponding helical angle. This difficulty is particularly acute when the tubing has no angle whatsoever, as in the commonly used and currently available tubing. Previous apparatuses therefore are only in partial contact with tubing while driving the tubing horizontally through an apparatus for perforating. This accounts, to a large extent, for the limitation in driving speed.

The present invention as defined by the apparatus 10 alleviates this problem by offsetting the wheel 12 and the drive shaft 14 by the previously discussed angle. By offsetting the wheel 12 and corresponding drive shaft 14, the threading 20 on each wheel 12 substantially contacts the tubing T along the valley of the corrugations thereon. This facilitates the efficient driving of the tubing T by the apparatus 10 and achieves the significantly increased through-put speeds of up to 200 feet per minute in small diameter tubing (diameters up to about 6 inches) and up to 100 feet per minute in larger diameter tubing (diameters greater than 8 inches). It is noted that machines that produce tubing currently cannot produce the tubing at larger diameters to fully utilize the upper productivity of the present perforator. For instance, in tubing of 12 inch diameter, the extrusion machine can only produce 12 feet of tubing per minute. The present invention can easily handle this output, while known machines can only approach 6 feet of tubing per minute. The present invention also eliminates the problems encountered by previous machines of cutter wheels riding up the ribs of the tubing and miscutting the tubing in either the side walls or the crown of the tubing. Thus, the present invention achieves higher speeds in perforation while eliminating any damage to the tubing during the perforation process.

It has been found that to most efficiently effect the offset angle, at least one U-joint is needed and normally two U-joints 28, 30 are desired. The U-joints 28, 30 allow for the achievement of the offset angle and transmission of rotational power, as is commonly known. One U-joint could, in some circumstances, be used. However, the use of a plurality of U-joints is preferred, as is known in the art.

Referring now again to FIG. 4, the means 18 for rotating the drive shaft 14 are seen, as comprising a plurality of drive wheels 32, a plurality of sprockets 34 and a belt 36. The drive wheels 32 are individually mounted upon each drive shaft 14 at the rearward portion 26 thereof. The belt 36 is wound around the drive wheels 32 and the sprockets 34. The sprockets 34 provide tension to keep the belt 36 in tight contact with the drive wheels 32 when in motion. The means 18 for rotating further comprises a transmission 40 in connection with an electric motor 42. The transmission 90 has a drive train connected to a sprocket 38 or, alternately, to one of the drive wheels 32. This imparts the necessary energy to allow effective operation of the means 18 for rotating the drive shaft 14 and the wheels 12.

Referring again to FIG. 1, it is noted that the apparatus 10 has three pairs of feeder-cutter wheels, the wheels indicated generally at 12 and in pairs as 12*a*, 12*b* and 12*c*. The design of the apparatus 10 is such that the wheels 12 are disposed in four planes. Specifically, the worms 18 of the wheels 12 are disposed in distinct planes. A single wheel of the first pair 12*a* is in a first plane. The corresponding wheel of the first pair 12*a* is in a second plane. The wheels of the second pair 12*b* are both deployed in separate planes, but strike the tubing in the same plane. The wheels of the third pair 12*c* are both deployed in a separate plane, but strike the tubing in the same plane.

The design of spacing the wheels 12 in four different planes, as opposed to one plane, offers a significant advantage over previous apparatuses for perforating tubing. Specifically, the deployment of the wheels 12 in four planes allows for the use different sized wheels 12 on the same apparatus 10. Thus, one apparatus 10 may perforate tubing of various diameters.

In achieving this versatility, and as noted previously the present apparatus 10 achieves this without requiring recalibration and resynchronization of the newly mounted wheels 12 and their associated drive shafts 14. This is due, in part, to the elimination of gears for driving the apparatus 10. Previously known apparatuses required new gear trains when deploying cutter wheels of different sizes. The present invention, also, fulfills the goal of being able to cut tubing of different sizes without recalibration. This is achieved by standardizing the drive shafts 14 for the receipt thereon of all worms, regardless of the size of wheels 12 mounted thereupon. It is recognized that cutting tubing will require greater torque in the wheels 12 as the tubing T increases in diameter, for as the diameter increases the pitch and thickness of the plastic in the corrugation increases. Thus, the transmission set forth in the present invention is shiftable between various rpm (revolution per minute) settings. Therefore, where the tubing is of a smaller diameter, a higher speed is achieved and a higher transmission speed is elected. Alternately, when a thicker tubing of greater diameter is to be cut, smaller wheels are mounted on the shaft 14 and a lower transmission speed is elected. This gives the wheels 12 greater torque and the needed power to cut through the thicker tubing. The present invention eliminates the additional cost of new gear trains when switching to tubing of different diameter. As noted the present invention enables the cutting of different diameter tubings.

Each pair of wheels is deployed such that the wheels 12*a* of each pair strike the tubing T and cut perforations therein at the same time. The first pair of wheels 12*a* strike concurrently to cut a first set perforations. The wheels 12*b* then strike the tubing T to cut a second set of perforations simultaneously and coplanarly. The wheels 12*b*, preferably, strike exactly 120° later than the wheels 12*a*. The wheels 12*c* then strike the tubing T cut a third set of perforations simultaneously and coplanarly, the wheels 12*c* striking 120° of rotation after the wheels 12*b* and 240° of rotation after the wheels 12*a*. The coordination of the wheels 12 produces six uniform lines of perforation along the length of the tubing T. Additionally, this coordination of cutter striking the tubing reduces the torque required of the motor, as the power needs are spread evenly over the rotation of the wheels, and is not required in a greater amount only once a revolution. An example of one embodiment hereof contemplated is an eight feeder-cutter wheels having three cutters per wheel. This provides twenty-four cutters. The cutters are staggered so that only two cutters strike at any one time, so that the torque required to cut is lower than otherwise required.

The use of two or more threadings can also be used in such a scheme, these multiple helixed wheels being known as multi-start wheels. The use of multiple cutters 22, 22'and 22" on the multi-start wheels results in a slower rotation and therefore the same throughput or by keeping the same rotational speed a greater throughput of the tubing T. The present invention still achieves a speed well in excess of 50 feet per minute and, thus, provides a significant improvement over known machines. This cutting of the tubing T can be helped by synchronizing the striking of each pair of cutters thus lessening the load upon the drive equipment.

When a single start or single thread wheel is deployed, the multiple cutters serve to cut into the same perforation being formed in the tubing T. Thus, each cutter serves to etch out a portion of the slit being made. This approach distributes the torque incurred when the cutting stroke occurs. This is superior to one cutter, since the torque incurred with one cutter is excessively high and affects the load put upon the motor and drive system. Thus, multiple cutters, which can be at least two, and as many as four, in the preferred embodiments and more than four in less preferred embodiments, achieve the cutting of greater diameter tubing at high speeds. Additionally, multiple cutters give a clearer slit and a cleaner opening.

It is also becoming popular in the art currently to produce dual wall tubing. Dual wall tubing is tubing having a corrugated outer surface and a smooth inner surface. Such tubing is useful for storm sewers. This tubing has less flexibility than corrugated tubing. The present invention can cut such tubing easily, while the prior art machines, such as Hegler, cannot make the necessary perforations and stay within the grooves of the tubing. The lack of flexibility of the dual wall tubing accentuates the drawbacks of such prior art machines.

It is envisioned that the present invention will be capable of accommodating a range of tubing diameters, as desired by the user. Thus, one apparatus may perforate tubing of diameters between 2 inches and 6 inches, while a second machine may perforate tubing over a range of 4 inches to 8 inches in diameter, with various permutations permissible, as desired. The present invention eliminates the need for purchasing extra gear works to adapt an apparatus to tubing of different sizes. The additional set-up time needed to synchronize differing sizes of wheels is, also, saved. The user need only initially synchronize the device and purchase the feeder-cutter wheel sets corresponding to the desired diameters. Tubing of diameters within the range serviceable by a particular apparatus 10 can thus be perforated without an additional expenditure of time otherwise necessary in resetting the machinery or replacing the drive means, such as the gears in previous machines. Savings in time and expenses in additional machine parts are, therefore, realized.

Thus, by providing groups of wheels, each group having wheels of substantially the same diameter to be mounted upon the drive shafts 14, a user may have groups or sets to accommodate the different diameters of tubing to be corrugated by that machine. A second group 13 of feeder-cutter wheels is shown in FIG. 1. The feeder cutter wheels 13*a*, 13*b*, 13*c*, 13*d*, 13*e*, and 13*f* of the second group 13 of feeder-cutter wheels have a smaller diameter size than the wheels of group 12. Consequently, the wheels of group 13 can be interchanged for the wheels of group 12 to perforate tubing having a larger diameter. As noted, the machines must be restricted to accommodating three to five different diameters, otherwise requiring recalibration. Only wheels within the specifications of a machine may function to cut different sized tubing when mounted upon the drive shafts without recalibration. The apparatus 10 and the various groups of wheels 12 to cut the tubing without recalibration form a tubing corrugation set for perforating corrugated tubing of different diameter.

It is to be noted that while the present invention has been described with three pairs of feeder-cutter wheels 12, the present invention can be practiced with two pairs of feeder-cutter wheels operating in three planes. Alternately, additional pairs of wheels operating in separate and distinct planes may be added, as needed or desired.

Although the present invention has been described herein with respect to a specific embodiment thereof, it will be understood that the foregoing description is intended to be illustrative, and restrictive. Many modifications of the present invention will occur to those skilled in the art. All such modifications which fall within the scope of the appended claims are intended to be within the scope and spirit of the present invention.

Having, thus, described the invention, what is claimed is:

1. An apparatus for cutting perforations in corrugated tubing as the tubing is passed along an axial path thereof, the apparatus comprising:

(a) at least one pair of feeder-cutter wheels, each wheel comprising a worm, a threading disposed upon the worm, and a plurality of cutters disposed within the threading, each wheel being adapted to continuously intersect the corrugation of the tubing;

(b) at least one pair of drive shafts, each drive shaft having a forward portion, a rearward portion, and at least one U-joint interconnecting the forward portion and the rearward portion, each drive shaft having one wheel axially mounted thereon, each drive shaft being deployed at an angle relative to the axial path of the tubing to apply pressure to the tubing as it is moved past the wheels;

means for rotating the drive shafts; and wherein the feeder-cutter wheels are operable to drive the tube along the axial path through the apparatus and to cut perforations in the corrugations of the tubing.

2. The apparatus of claim 1, wherein the angle at which each drive shaft is deployed relative to the axial path of the tubing is substantially equal to the helical angles of the threading upon the feeder-cutter wheels.

3. A tubing corrugation set capable of perforating corrugated tubings of different diameters without realignment, the set comprising:

(a) at least two groups of feeder-cutter wheels, each wheel of each group having the same diameter, each group comprising at least a pair of the wheels, the diameter of the wheels in one group being different from the diameter of the wheels of at least one another group, each group comprising at least one pair of feeder-cutter wheels, each wheel comprising a worm, a threading disposed upon the worm, and a plurality of cutters disposed within the threading, each wheel being adapted to continuously intersect the corrugation of the tubing;

(b) an apparatus for cutting perforations in corrugated tubing of a large diameter as the tubing is passed along an axial path thereof, the apparatus comprising:

(1) at least one pair of the at least two groups of drive shafts, each drive shaft having one wheel of one group of feeder-cutter wheels mounted thereon, the drive shafts being deployed at an angle relative to the axial path of the tubing to apply pressure to the tubing as it is moved past the wheels;

(2) means for rotating the drive shafts; and wherein the feeder-cutter wheels are operable to drive the tubing along the axial path through the apparatus and to cut perforations in the corrugation of the tubing, and further wherein the groups of wheels are interchangeable upon the drive shafts without requiring realignment of the drive shafts.

4. A tubing corrugation set capable of perforating corrugated tubings of different diameters without realignment, the set comprising:

(a) at least two groups of feeder-cutter wheels, each wheel of each group having the same diameter, each group comprising at least a pair of the wheels, the diameter of the wheels in one group being different from the diameter of the wheels of at least one other group, each group comprising at least one pair of feeder-cutter wheels, each wheel comprising a worm, a threading disposed upon the worm, and a plurality of cutters disposed within the threading, each wheel being adapted to continuously intersect the corrugation of the tubing;

(b) an apparatus for cutting perforations in corrugated tubing of a large diameter as the tubing is passed along an axial path thereof, the apparatus comprising:

(1) at least one pair of drive shafts, each drive shaft having a forward portion, a rearward portion, and at least one U-joint interconnecting the forward portion and the rearward portion, each drive shaft having one wheel of one group of feeder-cutter wheels mounted thereon, the drive shafts being deployed at an angle relative to the axial path of the tubing to apply pressure to the tubing as it is moved past the wheels;

(2) means for rotating the drive shafts; and wherein the feeder-cutter wheels are operable to drive the tubing along the axial path through the apparatus and to cut perforations in the corrugation of the tubing, and further wherein the groups of wheels are interchangeable upon the drive shafts without requiring realignment of the drive shafts.

5. The apparatus of claim 3, wherein the angle is substantially equal to the helical angle of the threadings upon the feeder-cutter wheels of each set.

* * * * *